US007917044B2

(12) United States Patent
Kishi

(10) Patent No.: US 7,917,044 B2
(45) Date of Patent: Mar. 29, 2011

(54) CONSUMABLE COMPONENT SELECTION BASED ON OPERATIONAL ENVIRONMENT OR CONDITION

(75) Inventor: Takehiro Kishi, Toride (JP)

(73) Assignee: Canon Kabushiki Kaisha (JP)

( * ) Notice: Subject to any disclaimer, the term of this patent is extended or adjusted under 35 U.S.C. 154(b) by 407 days.

(21) Appl. No.: 11/845,978

(22) Filed: Aug. 28, 2007

(65) Prior Publication Data

US 2008/0050130 A1 Feb. 28, 2008

(30) Foreign Application Priority Data

Aug. 28, 2006 (JP) ..... 2006-230731

(51) Int. Cl.
*G03G 15/00* (2006.01)

(52) U.S. Cl. ..... 399/24; 399/44

(58) Field of Classification Search ..... 399/24, 399/44, 43, 8, 49
See application file for complete search history.

(56) References Cited

U.S. PATENT DOCUMENTS

| | | | | |
|---|---|---|---|---|
| 5,305,199 | A * | 4/1994 | LoBiondo et al. | 705/28 |
| 5,946,523 | A * | 8/1999 | Fujioka et al. | 399/49 |
| 5,960,232 | A * | 9/1999 | Cheng | 399/55 |
| 6,529,692 | B1 * | 3/2003 | Haines et al. | 399/27 |
| 6,798,997 | B1 * | 9/2004 | Hayward et al. | 399/12 |
| 7,009,719 | B2 * | 3/2006 | Willis et al. | 358/1.1 |
| 7,085,503 | B2 * | 8/2006 | Mokuya | 399/8 |
| 2002/0093687 | A1 * | 7/2002 | Kerby | 358/3.14 |
| 2003/0139973 | A1 * | 7/2003 | Claremont et al. | 705/26 |
| 2003/0228163 | A1 * | 12/2003 | Yokoi et al. | 399/27 |
| 2004/0126123 | A1 * | 7/2004 | Koga et al. | 399/24 |
| 2005/0074246 | A1 * | 4/2005 | Hayward et al. | 399/8 |
| 2005/0141903 | A1 * | 6/2005 | Kwon | 399/24 |
| 2005/0163516 | A1 * | 7/2005 | Eom | 399/12 |
| 2007/0189784 | A1 * | 8/2007 | Ujigawa | 399/24 |
| 2008/0002995 | A1 * | 1/2008 | Kamisuwa et al. | 399/8 |
| 2008/0131148 | A1 * | 6/2008 | Wong | 399/27 |

FOREIGN PATENT DOCUMENTS

| | | | |
|---|---|---|---|
| JP | 03269549 | A * | 12/1991 |
| JP | 05188675 | A * | 7/1993 |
| JP | 08016047 | A * | 1/1996 |
| JP | 2000-332934 | A | 11/2000 |
| JP | 2002140375 | A * | 5/2002 |

* cited by examiner

*Primary Examiner* — Quana M Grainger
(74) *Attorney, Agent, or Firm* — Rossi, Kimms & McDowell LLP

(57) ABSTRACT

A consumable component sorting system which make it possible to prolong the service life of a consumable component and reduce cost burdened on a user. An image forming apparatus collects information on its own operational environment or operational condition. A data server estimates a change in characteristics of the consumable component used in the image forming apparatus based on the information on the operational environment or the operational condition of the same collected thereby. A component managing server sorts out a consumable component suited to the operational environment or the operational condition of the image forming apparatus, based on the result of the estimation of the data server.

2 Claims, 6 Drawing Sheets

IMAGE FORMING APPARATUS
S401
COLLECT DATA
S402
SEND DATA

DATA SERVER
S411
RECEIVE DATA
S412
CARRY OUT STATISTICAL COMPUTATION PROCESSING
S413
DETERMINE AVERAGE TEMPERATURE AND HUMIDITY
S414
LOWER THAN 23°C
LOWER THAN 30%
S415
23~27°C
30~70%
S416
HIGHER THAN 27°C
HIGHER THAN 70%
A
B
C

| CONDITION | AD,AE,AF, BD | BE | BF,CD,CE, CF |
|---|---|---|---|
| SUITABLE ELECYTRIC RESISTANCE (Ω) | $9\times10^{6}$~ $1\times10^{7}$ | $1\times10^{7}$~ $2\times10^{7}$ | $2\times10^{7}$~ $3\times10^{7}$ |

CONSUMABLE COMPONENT SELECTION BASED ON OPERATIONAL ENVIRONMENT OR CONDITION

BACKGROUND OF THE INVENTION

1. Field of the Invention

The present invention relates to a consumable component sorting system, an information managing apparatus, a component managing apparatus, a control method, and a program for implementing the control method.

2. Description of the Related Art

Conventionally, an electrophotographic image forming apparatus performs image formation by electrostatically transferring an image developed from a latent image formed on a photosensitive member as an image bearing member, onto a transfer material (sheet), and then heating and pressing the transfer material by a fixing unit to fix the image.

Among the components mounted in the image forming apparatus, particularly ones involved in the operations of an image forming process are configured to be exchangeable as consumable components. Typical consumable components include a photosensitive drum as an image bearing member, a transfer roller as a component of a transfer unit, and a fixing roller as a component of the fixing unit. Timing for exchanging a consumable component is generally set with reference to a predetermined number of sheets to be output for image forming operation.

In recent years, a system called an SCM (Supply Chain Management) system has been under development. The SCM system implements a management method which makes it possible to integrate commodity supply systems including an order placement/reception system, a material/component procurement system, a production system, a product delivery system, and so on, and perform centralized management of the commodity supply systems by using IT (information technology), to thereby increase a company's profit.

On the other hand, among image forming apparatuses, an increasing number of copying machines have been developed from stand-alone machines into digital multifunction machines having a function of establishing connection to a remote communication network, such as a LAN (see e.g. Japanese Laid-Open Patent Publication (Kokai) No. 2000-332934).

The service lives of many of the consumable components used in the above-mentioned ectrophotographic image forming apparatus largely vary depending on the temperature and humidity of an environment in which the apparatus is installed, the type of transfer materials for use in image formation, the density of images formed on the transfer materials, and so forth. For this reason, degradation of image quality or the like problem can occur before arrival of exchange timing set for each consumable component. In this case, a user of the image forming apparatus is forced to cope with a problem with each consumable component (e.g. by advancing the exchange timing).

However, when the user of the image forming apparatus is to cope with a problem with each consumable component as mentioned above, the number of times of dispatch of a service person by the manufacturer or the like of the image forming apparatus increases, which causes an increase in cost both on the user side and the manufacturer side. Further, stoppage time of the image forming apparatus required for consumable component exchange increases, which causes significant efficiency degradation.

With a view to solving the above-mentioned problems, if exchange timing for each consumable component is so set as to be satisfactory for all environments for installation of an image forming apparatus, exchange timings for some consumable components are unnecessarily advanced. More specifically, in an image forming apparatus in use in a relatively low-load environment, consumable components that are still usable are exchanged earlier than required. This costs the user more than necessary. Further, since it is required to prepare numerous components for replacement, environmental load increases.

A manufacturer or a management company can also take measures to solve the above-mentioned problems by preparing a plurality of consumable components of different kinds suitable for installation environments specific to respective image forming apparatuses. In this case, however, it is predicted that cost will increase due to elongation of a time period required for development of an image forming apparatus and necessity of component management. Therefore, this method also costs the user more than necessary, and an increase in environmental load due to necessity of numerous components for replacement.

SUMMARY OF THE INVENTION

The present invention provides a consumable component sorting system, an information managing apparatus, a component managing apparatus, a control method, and a program for implementing the control method, which make it possible to prolong the service life of a consumable component and reduce cost burdened on a user.

In a first aspect of the present invention, there is provided a consumable component sorting system including an image forming apparatus having a consumable component exchangeably mounted therein, an information managing apparatus, and a component managing apparatus, which are communicably connected to each other, wherein the image forming apparatus comprises an information collecting unit configured to collect information on an operational environment or an operational condition thereof, wherein the information managing apparatus comprises an estimating unit configured to estimate a change in characteristics of the consumable component based on the information on the operational environment or the operational condition of the image forming apparatus collected by the information collecting unit, and wherein the component managing apparatus comprises a sorting unit configured to sort out a consumable component suited to the operational environment or the operational condition of the image forming apparatus, based on a result of the estimation of the estimating unit.

With the configuration of the first aspect of the present invention, a consumable component for use in an image forming apparatus and information collected by the image forming apparatus are associated with each other, and a consumable component is sorted out from those which vary in characteristics, according to the operational environment or operational condition of the image forming apparatus, whereby the supply destination of the consumable component which varies depending on the manufacturing process is optimized. This makes it possible to prolong the service life of the consumable component as well as to reduce cost burdened on the user. Further, a manufacturer need not manufacture more consumable components than necessary, which makes it possible to reduce load on environment caused by manufacturing load and waste disposal load.

The information on the operational environment of the image forming apparatus includes information on at least one of temperature and humidity.

The information on the operational condition of the image forming apparatus includes information on at least one of basis weights of sheets for use in image formation, sizes of the sheets for use in image formation, and a sheet count of sheets supplied for image forming operation.

The information on the operational condition of the image forming apparatus includes information on at least one of a ratio between frequency of a monochrome image forming operation and frequency of a color image forming operation, a ratio between applied image densities, and a ratio of image area to sheet area on which images are formed.

The image forming apparatus comprises a display unit configured to display information on the change in characteristics of the consumable component sent by the information managing apparatus.

The consumable component includes at least one of an image bearing member configured to have a latent image formed thereon and developed, a transfer unit configured to transfer the image developed on the image bearing member onto a sheet, and a fixing unit configured to fix the image transferred onto the sheet.

In a second aspect of the present invention, there is provided an information managing apparatus communicably connected to an image forming apparatus having a consumable component exchangeably mounted therein, comprising an estimating unit configured to estimate a change in characteristics of the consumable component used in the image forming apparatus based on information on an operational environment or an operational condition of the image forming apparatus collected by the image forming apparatus.

In a third aspect of the present invention, there is provided a component managing apparatus communicably connected to an information managing apparatus that manages information collected by an image forming apparatus having a consumable component exchangeably mounted therein, comprising a sorting unit configured to sort out a consumable component suited to an operational environment or an operational condition of the image forming apparatus, based on a change in characteristics of the consumable component used in the image forming apparatus, which has been estimated by the information managing apparatus.

In a fourth aspect of the present invention, there is provided a method of controlling a consumable component sorting system including an image forming apparatus having a consumable component exchangeably mounted therein, an information managing apparatus, and a component managing apparatus, which are communicably connected to each other, comprising an information collecting step of collecting information on an operational environment or an operational condition of the image forming apparatus, an estimating step of estimating a change in characteristics of the consumable component based on the information on the operational environment or the operational condition of the image forming apparatus collected in the information collecting step, and a sorting step of sorting out a consumable component suited to the operational environment or the operational condition of the image forming apparatus, based on a result of the estimation in the estimating step.

In a fifth aspect of the present invention, there is provided a method of controlling an information managing apparatus communicably connected to an image forming apparatus having a consumable component exchangeably mounted therein, comprising a receiving step of receiving information on an operational environment or an operational condition of the image forming apparatus collected by the image forming apparatus, and an estimating step of estimating a change in characteristics of the consumable component based on the information on the operational environment or the operational condition of the image forming apparatus received in the receiving step.

In a sixth aspect of the present invention, there is provided a method of controlling a component managing apparatus communicably connected to an information managing apparatus that manages information collected by an image forming apparatus having a consumable component exchangeably mounted therein, comprising a receiving step of receiving information on a change in characteristics of the consumable component used in the image forming apparatus, which has been estimated by the information managing apparatus, and a sorting step of sorting out a consumable component suited to the operational environment or the operational condition of the image forming apparatus, based on the change in characteristics of the consumable component used in the image forming apparatus.

In a seventh aspect of the present invention, there is provided a program for causing a computer to execute a method of method of controlling an information managing apparatus communicably connected to an image forming apparatus having a consumable component exchangeably mounted therein, wherein the method comprises a receiving step of receiving information on an operational environment or an operational condition of the image forming apparatus collected by the image forming apparatus, and an estimating step of estimating a change in characteristics of the consumable component based on the information on the operational environment or the operational condition of the image forming apparatus received in the receiving step.

In an eighth aspect of the present invention, there is provided a program for causing a computer to execute a method of controlling a component managing apparatus communicably connected to an information managing apparatus that manages information collected by an image forming apparatus having a consumable component exchangeably mounted therein, wherein the method comprises a receiving step of receiving information on a change in characteristics of the consumable component used in the image forming apparatus, which has been estimated by the information managing apparatus, and a sorting step of sorting out a consumable component suited to the operational environment or the operational condition of the image forming apparatus, based on the change in characteristics of the consumable component used in the image forming apparatus.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof. First, the general arrangement of an image forming apparatus will be described with reference to FIG. 1.

Figure 1:
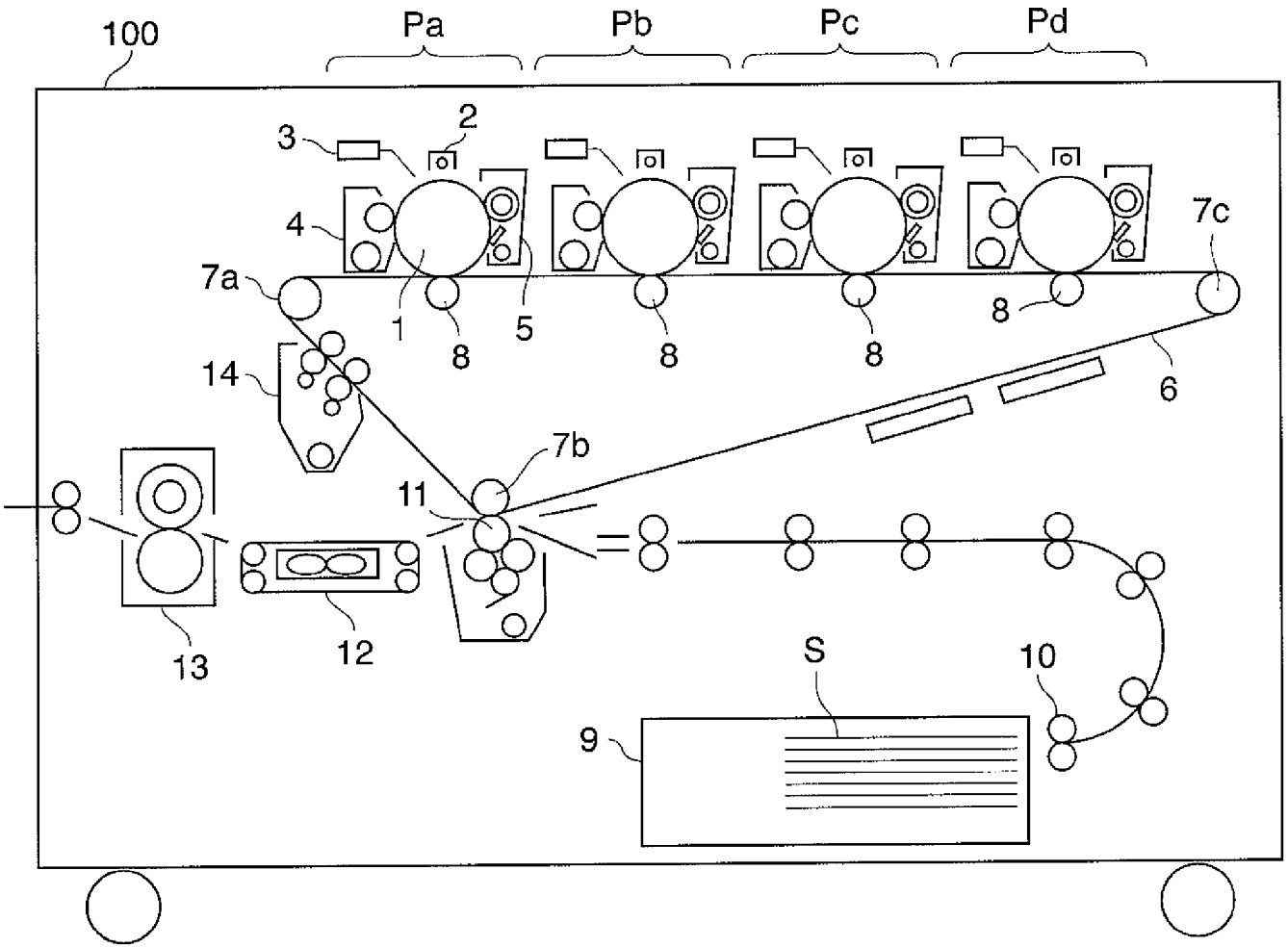
FIG. 1 is a schematic view of an image forming apparatus as a component of a consumable component sorting system according to an embodiment of the present invention.

FIG. 1 is a schematic view of an image forming apparatus as a component of a consumable component sorting system according to the embodiment of the present invention.

As shown in FIG. 1, in an upper part of the housing of the image forming apparatus, there are arranged four image-forming stations Pa, Pb, Pc, and Pd in the mentioned order from the left, as viewed in the figure, for forming a yellow developer image, a magenta developer image, a cyan developer image, and a black developer image, respectively. The image-forming stations Pa, Pb, Pc, and Pd are identical in construction, and each of the image-forming stations is distinguished from the others only by the color of an associated developer (hereinafter referred to as "toner"). Therefore, only component elements of the yellow image-forming station Pa are designated by reference numerals.

In the following, a brief description will be given of the arrangement of an image-forming station by taking an example of the yellow image-forming station Pa as the representative of the image-forming stations Pa to Pd. The image-forming station Pa is provided with a photosensitive drum 1 as an image bearing member which can rotate in the counterclockwise direction, as viewed in FIG. 1. Around the photosensitive drum 1, there are arranged an electrostatic charger 2, an exposure unit 3, a developing unit 4, and a cleaning unit 5 in the mentioned order in the direction of rotation of the photosensitive drum 1. The electrostatic charger 2 electrically charges the surface of the photosensitive drum 1. The exposure unit 3 selectively exposes the photosensitive drum 1. The developing unit 4 develops a latent image formed on the photosensitive drum 1, by toner. The cleaning unit 5 cleans the photosensitive drum 1 after completion of toner transfer.

The image-forming stations Pa to Pd are arranged in the substantially horizontal direction and in parallel relation. An intermediate transfer belt 6 as an intermediate transfer member is wound around a driving roller 7*a* and driven rollers 7*b* and 7*c* and disposed below the image-forming stations Pa to Pd such that the intermediate transfer belt 6 can be brought into contact with each of the photosensitive drums 1. The intermediate transfer belt 6 is driven for counterclockwise rotation, as viewed in FIG. 1, via the driving roller 7*a* and the driven rollers 7*b* and 7*c*.

Primary transfer rollers 8 are arranged on the inner periphery side of the intermediate transfer belt 6 at respective locations opposed to the photosensitive drums 1 of the respective image-forming stations Pa to Pd, to form a primary transfer section. Each of the primary transfer rollers 8 comes into contact with the intermediate transfer belt 6 to form a nip. Further, a secondary transfer roller 11 is disposed on the outer periphery side of the intermediate transfer belt 6 at a location opposed to the driven roller 7*b*, to form a secondary transfer section. The secondary transfer roller 11 comes into contact with the intermediate transfer belt 6 to form a nip.

In a lower part of the housing of the image forming apparatus, there is mounted a transfer material cassette 9 containing a plurality of transfer materials (sheets) S. A transfer material S is fed from the transfer material cassette 9 and is conveyed to the secondary transfer section by a conveying roller pair 10. A conveyor belt 12 is disposed downstream of the secondary transfer section so as to convey a transfer material S having undergone secondary transfer. Further, disposed downstream of the conveyor belt 12 is a fixing unit 13 comprised of a pressing roller and a fixing roller. The fixing unit 13 presses and heats a transfer material S to thereby fix a toner image on the same.

In the image-forming stations Pa to Pd of the image forming apparatus constructed as above, respective toner images of yellow, magenta, cyan, and black are sequentially formed on the respective photosensitive drums 1 by the respective electrostatic chargers 2, exposure units 3, and developing units 4. In the primary transfer section, the toner images on the photosensitive drums 1 of the respective image-forming stations Pa to Pd are primarily transferred onto the intermediate transfer belt 6 in superimposed relation, whereby a full-color toner image is formed on the intermediate transfer belt 6.

In the meantime, a transfer material S is fed from the transfer material cassette 9 and is conveyed to the nip of the secondary transfer section by the conveying roller pair 10 in timing synchronous with formation of the toner image on the intermediate transfer belt 6. In the secondary transfer section, bias voltage is applied to the secondary transfer roller 11 to thereby secondarily transfer the toner image onto the transfer material S. Thus, the full-color toner image is formed on the transfer material S.

The transfer material S having the toner image transferred thereon is conveyed to the fixing unit 13 by the conveyor belt 12. The fixing unit 13 heats and presses the toner image on the transfer material S to thereby fix the toner image on the same. The transfer material S having the toner image fixed thereon is discharged out of the housing of the image forming apparatus. Toner remaining on the intermediate transfer belt 6 after completion of the transfer of the toner image onto the transfer material S is removed by the cleaning unit 14.

Next, a description will be given of the secondary transfer roller 11 whose characteristic largely varies depending on the operational environment of the image forming apparatus. The secondary transfer section is where a toner image and a transfer material come into contact with each other, as described hereinabove, and hence the secondary transfer roller 11 forming the secondary transfer section is directly influenced by toner and transfer materials. The secondary transfer roller 11 is implemented by a sponge roller having a low hardness, so as to enhance transferability of a toner image onto a transfer material S.

Figure 2:
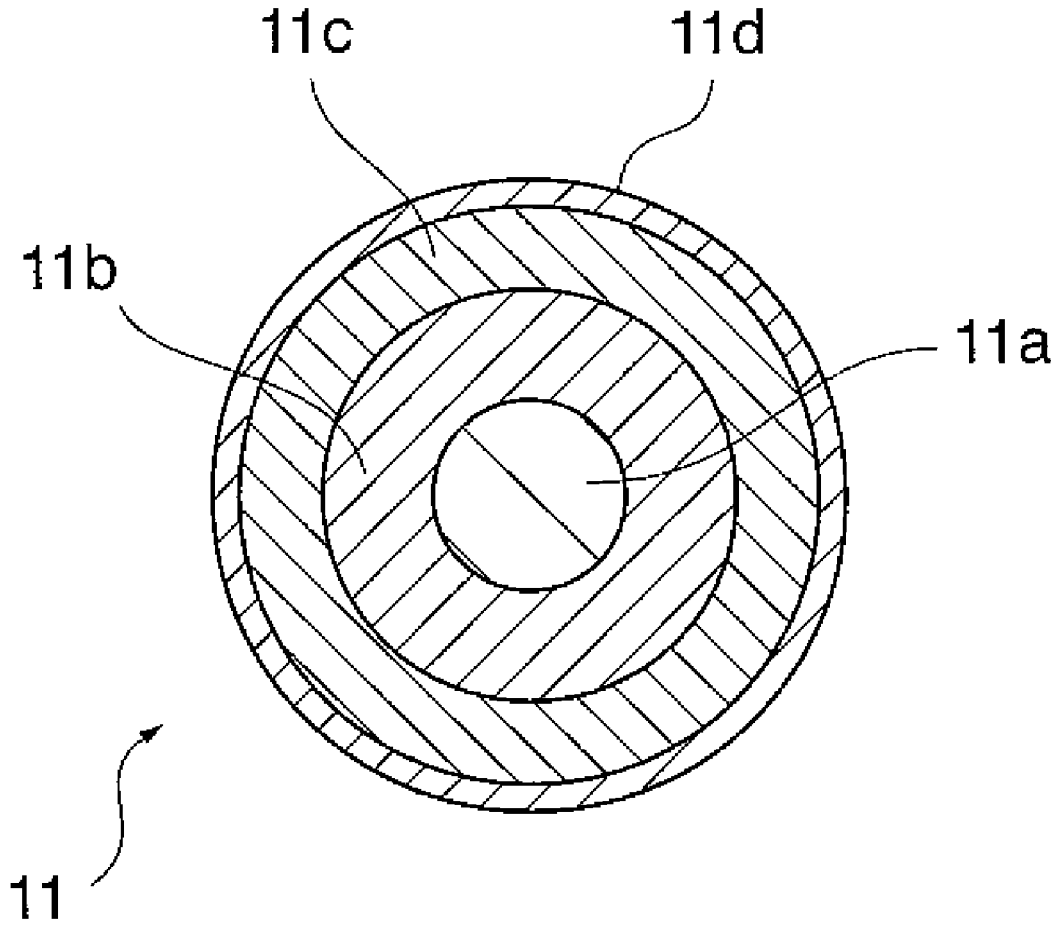
FIG. 2 is a schematic cross-sectional view of a secondary transfer roller of the image forming apparatus.

FIG. 2 is a schematic cross-sectional view of the secondary transfer roller 11 of the image forming apparatus.

As shown in FIG. 2, the secondary transfer roller 11 is comprised of a core metal 11*a*, a sponge layer 11*b*, a solid rubber layer 11*c*, and a coating layer 11*d*. More specifically, the secondary transfer roller 11 has the sponge layer 11*b* surrounding the core metal 11*a*, the solid rubber layer 11*c* surrounding the sponge layer 11*b*, and the coating layer 11*d* formed on the surface of the solid rubber layer 11*c*. Thus, the secondary transfer roller 11 is formed with a relatively smooth surface having excellent toner releasability.

In the secondary transfer section, bias voltage is applied to the secondary transfer roller 11 to thereby transfer a toner image onto a transfer material. Therefore, each of the core metal 11*a* and the solid rubber layer 11*c* of the secondary transfer roller 11 has an electric resistance of the surface thereof set to e.g. $9\times10^6$ to $3\times10^7\Omega$ (at a temperature of 22° C. and a humidity of 55%, for example). Further, from the viewpoint of improving the conveyability of a transfer material, the surface roughness of the coating layer 11*d* is set to 6 to 12 μm. Furthermore, from the viewpoint of improving both the transferability and conveyability of a transfer material, the hardness of the entire secondary transfer roller 11 is set to 30 to 36° (Asker hardness).

It is well known that the electric resistance, surface roughness, and hardness of the secondary transfer roller 11 vary depending on the composition of rubber, the molding condition, the season, and so forth, which is a factor causing variation in image quality of products (printed matter) output from an image forming apparatus.

In general, the service life of a secondary transfer roller is set based on the amount of change in the electric resistance of the secondary transfer roller. For this reason, when the electric resistance of the secondary transfer roller increases with an increase in the total amount of electric current applied to the secondary transfer roller, a difference is produced between the electric resistance of a transfer material and that of the secondary transfer roller, which causes an electric field difference at ends of the transfer material, resulting in degradation of image quality. Further, as the electric resistance of the secondary transfer roller increases, difference in electric resistance between a toner-image area covered with a toner image on the transfer material and a non-toner-image area not covered with the toner image on the transfer material becomes larger. This also causes an electric field difference on the boundary of the two areas, resulting in degradation of image quality.

The electric resistance of the secondary transfer roller also changes depending on the operational environment of the image forming apparatus. The electric resistance is lower under a high-temperature and high-humidity environment, and is higher under a low-temperature and low-humidity environment. Therefore, for example, if a secondary transfer roller with a high electric resistance is supplied to a user under a high-temperature and high-humidity environment, it is possible to maintain image quality for a long term without reducing the operational range. Conversely, if a secondary transfer roller with a low electric resistance is supplied to a user under a low-temperature and low-humidity environment, it is possible to maintain image quality for a long term.

The operational environment of an image forming apparatus can be measured by a temperature and humidity sensor provided in the image forming apparatus. Data of the operational environment of the image forming apparatus measured by the temperature and humidity sensor is sent to a data server (see FIG. 3) connected to a remote communication network, as a component of the consumable component sorting system, to be cumulatively stored in the data server.

Similarly, by supplying a suitable secondary transfer roller to a user who uses an image forming apparatus in a one-sided operational condition, it is possible to maintain image quality for a long term. For example, by supplying a user who tends to use thick sheets having high electric resistance, as transfer materials, with a secondary transfer roller having a higher electric resistance, so as to reduce the difference in electric resistance between a transfer material and the secondary transfer roller, it is possible to maintain image quality for a long term.

Information on the operational condition of an image forming apparatus is collected as operational condition data. The operational condition data includes sheet thickness detection information from a sheet thickness sensor installed in the image forming apparatus, and transfer material information, such as a transfer material type and a transfer material size input by a user. The operational condition data is sent to the data server (see FIG. 3) connected to the remote communication network, as a component of the consumable component sorting system, to be cumulatively stored in the data server.

As is apparent from the above description, the service life of a secondary transfer roller largely changes depending on the operational environment or operational condition of an image forming apparatus. Therefore, if a secondary transfer roller having favorable conditions is supplied to a user according to the operational environment or operational condition of an image forming apparatus, it is possible to prolong the service life of the secondary transfer roller.

Next, the consumable component sorting system according to the present embodiment will be described with reference to FIG. 3.

Figure 3:
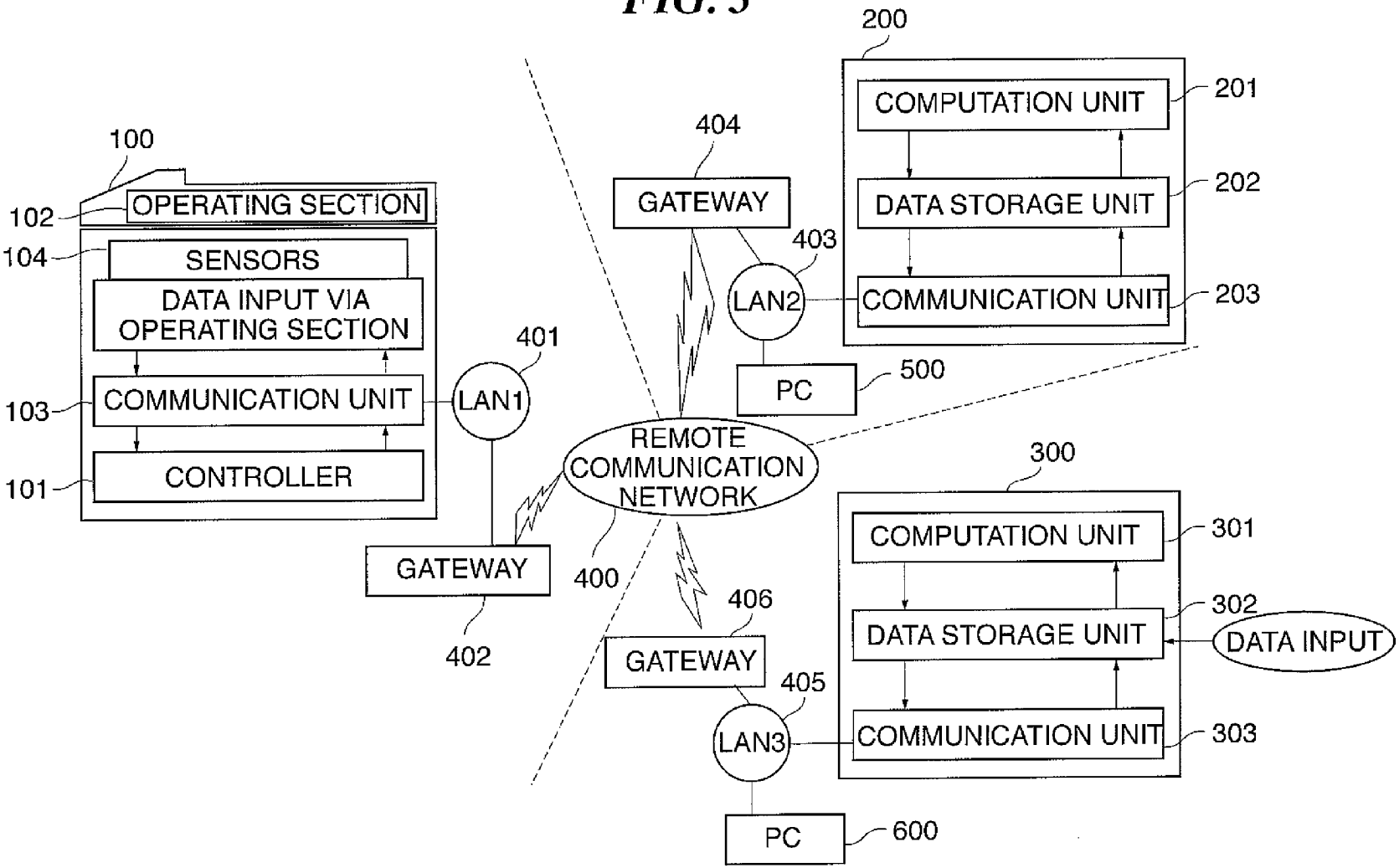
FIG. 3 is a schematic block diagram of the consumable component sorting system.

FIG. 3 is a schematic block diagram of the consumable component sorting system.

As shown in FIG. 3, the consumable component sorting system is comprised of the image forming apparatus 100, the data server 200, a component managing server 300, and the remote communication network 400. The image forming apparatus 100 is installed at a user site. The data server 200 is installed in a management center of an image forming apparatus dealer. The component managing server 300 is installed in a component managing center of the manufacturer of the image forming apparatus. The remote communication network 400 is implemented e.g. by a telephone line, such as a public/private line, or the Internet. It should be noted that when the remote communication network 400 is not implemented by the telephone line, it is required to use an interface.

In a system communicably interconnecting a manufacturer, generally, a dealer, and a user, a plurality of user sites are connected to a data server managed by the dealer. Further, the dealer can manage a plurality of data servers. In the present embodiment, however, the following description will be given by taking an example of the single data server managed by the single dealer and the single user site. In the following, the configuration and function of each of the image forming apparatus 100, the data server 200, and the component managing server 300 will be described in more detail.

First, a description will be given of the configuration of part of the consumable component sorting system including the image forming apparatus 100 at the user site. The image forming apparatus 100 is connected, via a LAN 401, to a gateway 402 connected to the remote communication network 400. The image forming apparatus 100 is communicably connected to the data server 200 on the dealer side at all times or as required, via the gateway 402, the remote communication network 400, and a gateway 404. Further, the image forming apparatus 100 is communicably connected to the component managing server 300 on the manufacturer side at all times or as required, via the gateway 402, the remote communication network 400, and a gateway 406.

The image forming apparatus 100 is comprised of a controller 101, an operating section 102, a communication unit 103, and sensors 104. The controller 101 not only controls the overall operation of the image forming apparatus 100, but also has a function of collecting data concerning the operational environment and operational condition of the image forming apparatus 100. Further, the controller 101 carries out data collecting processing and data transmitting processing shown in flowcharts in FIGS. 4A and 5A, according to a program. The operating section 102 is used to configure various settings of the image forming apparatus 100. The operating section 102 includes a display unit (not shown) that can display a result of determination of a change in characteristics of a consumable component, which is sent from the data server 200. The transfer material information, which is input by a user via the operating section 102, indicative of the type and size of a transfer material used for image formation is operational condition data.

The communication unit 103 communicates with an external apparatus via the LAN 401, the gateway 402, and the remote communication network 400. The sensors 104 are used to collect data concerning the operational environment and operational condition of the image forming apparatus 100. The sensors 104 include the temperature and humidity sensor for detecting temperature and humidity as an operational environment and the sheet thickness sensor for detecting the thickness of a transfer material as an operational condition. The temperature and humidity detected by the temperature and humidity sensor is operational environment data, and the transfer material thickness detected by the sheet thickness sensor is operational condition data.

Next, a description will be given of the configuration of part of the consumable component sorting system including the data server 200 on the dealer side. The data server 200 is communicably connected to the image forming apparatus 100 at the user site at all times or as required, via the gateway 404, the remote communication network 400, and the gateway 402. Further, the data server 200 is communicably connected to the component managing server 300 on the manufacturer side at all times or as required, via the gateway 404, the remote communication network 400, and the gateway 406.

The data server 200 is comprised of a computation unit 201, a data storage unit 202, and a communication unit 203. The computation unit 201 carries out statistical computation processing shown in flowcharts in FIGS. 4B and 5B, according to a program. The computation unit 201 performs statistical computation of the operational environment and operational condition of the image forming apparatus 100, with an algorithm, based on data automatically collected by the image forming apparatus 100, to thereby estimate a change in characteristics of a consumable component. The data storage unit 202 stores data (data concerning the operational environment and operational condition of the image forming apparatus) sent from the image forming apparatus 100. The communication unit 203 communicates with an external apparatus via a LAN 403, the gateway 404, and the remote communication network 400.

A computer (PC) 500 is connected to the gateway 404 via the LAN 403. The computer 500 plays the role of a window terminal for carrying out processing using data managed by the data server 200. It should be noted that an algorithm with which data collected by the image forming apparatus 100 is processed may be constructed in the computer 500, and be executed by an instruction from the image forming apparatus 100. Further, some of the functions of the data server 200 may be moved to the computer 500.

Next, a description will be given of the configuration of part of the consumable component sorting system including the component managing server 300 on the manufacturer side. The component managing server 300 is communicably connected to the data server 200 on the dealer side at all times or as required, via the gateway 406, the remote communication network 400, and the gateway 404. Further, the component managing server 300 is communicably connected to the image forming apparatus 100 at the user site at all times or as required, via the gateway 406, the remote communication network 400, and the gateway 402.

The component managing server 300 is comprised of a computation unit 301, a data storage unit 302, and a communication unit 303. The computation unit 301 calculates conditions of a consumable component having optimal component characteristic tendency, with an algorithm, based on a result of the estimation of the data server 200. Further, the computation unit 301 compares the result of the calculation with component data of consumable components managed by the component managing server 300 to thereby select a consumable component best suited to the operational environment or operational condition of the image forming apparatus 100. The data storage unit 302 stores the component data of the consumable components managed by the component managing server 300. The communication unit 303 communicates with an external apparatus via a LAN 405, the gateway 406, and the remote communication network 400.

A computer (PC) 600 is connected to the gateway 406 via the LAN 405. The computer 600 plays the role of a window terminal for carrying out processing utilizing the component data managed by the component managing server 300. It should be noted that a part of the function of the component managing server 300 may be moved to the computer 600.

In the present embodiment, data concerning the operational environment of the image forming apparatus includes data of temperature and humidity. On the other hand, the data concerning the operational condition of the image forming apparatus includes data of sheet types indicative of the types of sheets as transfer materials used by the image forming apparatus, sheet basis weights indicative of the basis weights of the sheet, sheet sizes indicative of the sizes of sheets, and a sheet feed count indicative of the number of sheets passed through the secondary transfer section. Further, the data concerning the operational condition of the image forming apparatus include a ratio between the frequency of monochrome image forming operation and that of color image forming operation, a ratio between applied image densities, and a ratio of image area to sheet area on which images are formed.

Next, data processing for determining the operational environment of the image forming apparatus and data processing for determining the operational condition of the image forming apparatus will be described with reference to FIGS. 4A and 4B and FIGS. 5A and 5B. It should be noted that in the following description, the secondary transfer roller is taken as an example of a consumable component.

Figures 4A, 4B:
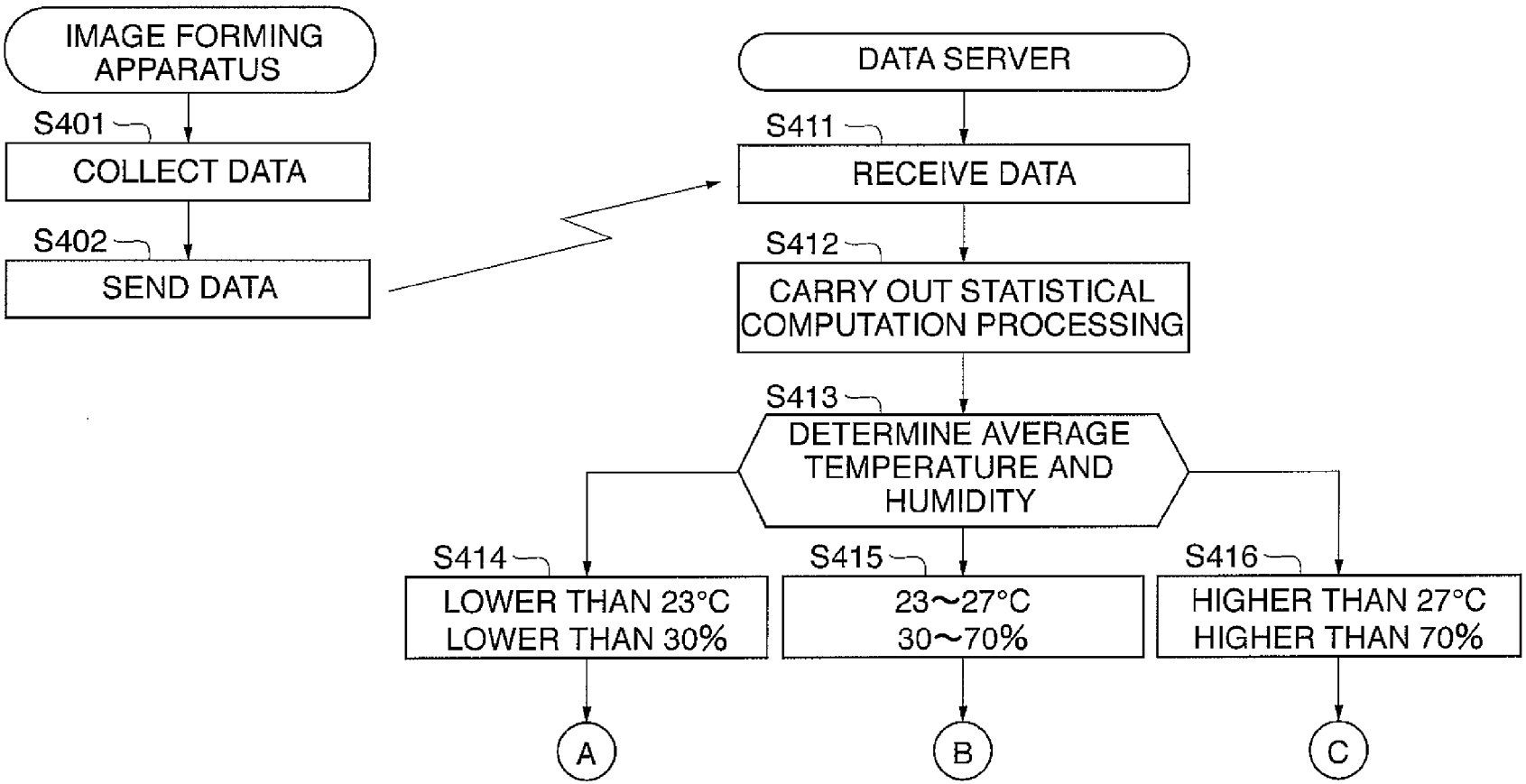
FIG. 4A is a flowchart useful in explaining data collecting processing and data transmitting processing carried out by the image forming apparatus.
FIG. 4B is a flowchart showing an example of data processing carried out by a data server, for determining an operational environment of the image forming apparatus.

FIG. 4A is a flowchart useful in explaining data collecting processing and data transmitting processing carried out by the image forming apparatus 100, and FIG. 4B is a flowchart showing an example of data processing carried out by the data server 200, for determining the operational environment of the image forming apparatus 100.

Referring to FIG. 4A, the controller 101 of the image forming apparatus 100 periodically collects operational environment data indicative of the operational environment (average temperature and humidity) of the image forming apparatus 100 detected by the temperature and humidity sensor, and stores the collected data in a memory, not shown (step S401). Then, the controller 101 causes the communication unit 103 to send the operational environment data stored in the memory to the data server 200 via the LAN 401, the gateway 402, and the remote communication network 400 (step S402).

Referring to FIG. 4B, the communication unit 203 of the data server 200 receives the operational environment data sent from the image forming apparatus 100, via the remote communication network 400, the gateway 404, and the LAN 403, and the data storage unit 202 stores the operational environment data (step S411). Then, the computation unit 201 carries out statistical computation processing on the operational environment data received from the image forming apparatus 100 (step S412).

Next, the computation unit 201 determines a range within which falls each of the average temperature and the average humidity as the operational environment of the image forming apparatus 100 (step S413). If the average temperature is lower than 23° C. and the average humidity is lower than 30% (step S414), it is determined that the image forming apparatus 100 is in an operational environment A. If the average temperature is within a range of 23 to 27° C. and the average humidity is within a range of 30 to 70% (step S415), it is determined that the image forming apparatus 100 is in an operational environment B. If the average temperature is higher than 27° C. and the average humidity is higher than 70% (step S416), it is determined that the image forming apparatus 100 is in an operational environment C.

Figures 5A, 5B:
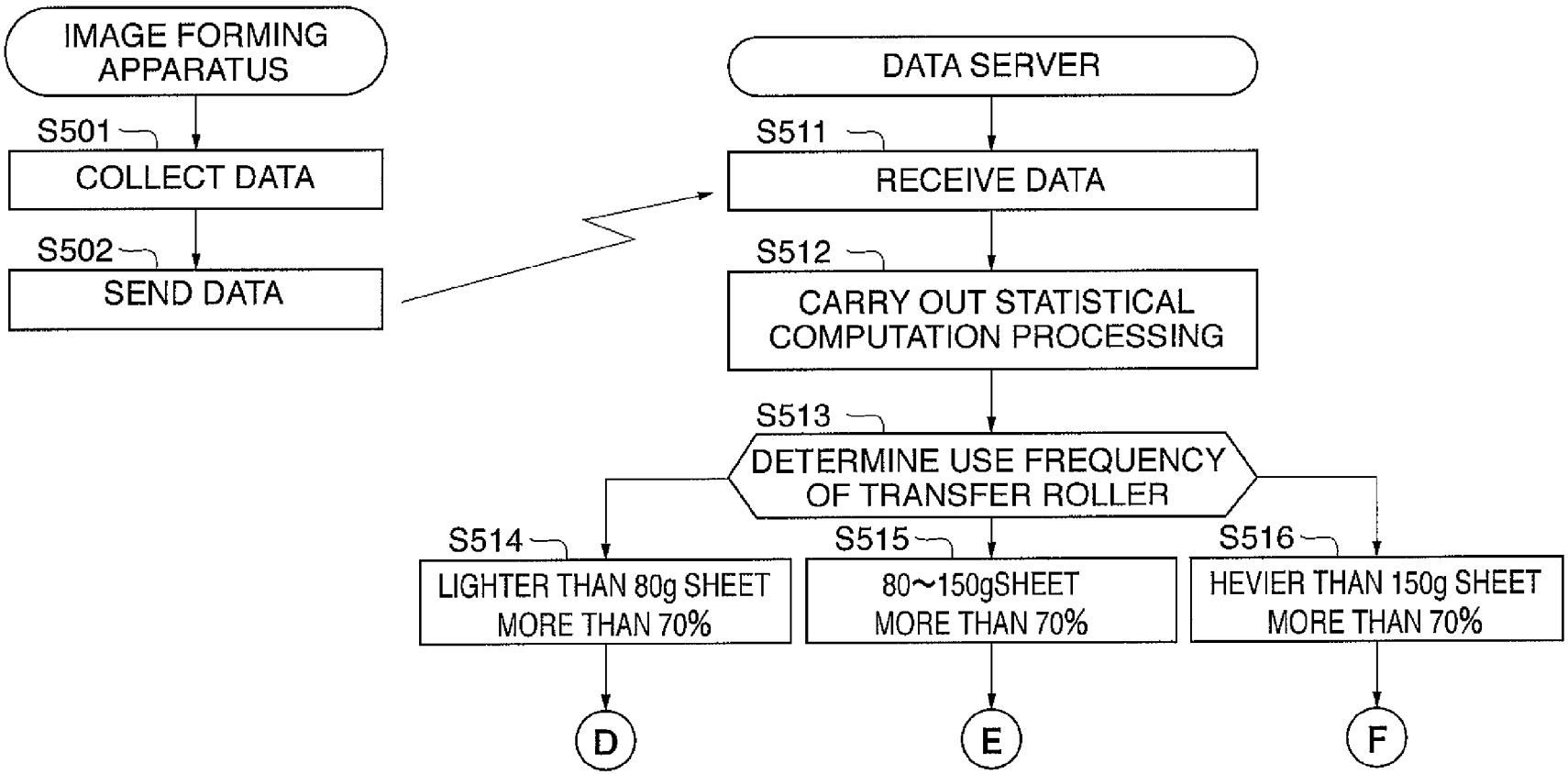
FIG. 5A is a flowchart useful in explaining data collecting processing and data transmitting processing carried out by the image forming apparatus.
FIG. 5B is a flowchart showing an example of data processing carried out by the data server, for estimating an operational condition of the image forming apparatus.

FIG. 5A is a flowchart useful in explaining data collecting processing and data transmitting processing carried out by the image forming apparatus 100, and FIG. 5B is a flowchart showing an example of data processing carried out by the data server 200, for determining the operational condition of the image forming apparatus 100.

Referring to FIG. 5A, the controller 101 of the image forming apparatus 100 periodically collects operational condition data indicative of the operational condition (use frequency) of the image forming apparatus 100 and stores the collected data in the memory, not shown (step S501). Then, the controller 101 causes the communication unit 103 to send the operational condition data cumulatively stored in the memory to the data server 200 via the LAN 401, the gateway 402, and the remote communication network 400 (step S502).

Referring to FIG. 5B, the communication unit 203 of the data server 200 receives the operational condition data sent from the image forming apparatus 100, via the remote communication network 400, the gateway 404, and the LAN 403, and the data storage unit 202 stores the operational condition data (step S511). Then, the computation unit 201 carries out statistical computation processing on the operational condition data received from the image forming apparatus 100 (step S512).

Next, the computation unit 201 determines a range within which falls the sheet type-dependent use frequency of the secondary transfer roller 11 as the operational condition of the image forming apparatus 100 (step S513). If more than 70% of transfer materials subjected to secondary transfer by the secondary transfer roller 11 is occupied by transfer materials of sheet types lighter than the "80 g sheet" type (step S514), it is determined that the image forming apparatus 100 is in an operational condition D. If more than 70% of the transfer materials subjected to secondary transfer by the secondary transfer roller 11 is occupied by transfer materials of "80 g to 150 g sheet" types (step S515), it is determined that the image forming apparatus 100 is in an operational condition E. If more than 70% of transfer materials subjected to secondary transfer by the secondary transfer roller 11 is occupied by transfer materials of sheet types heavier than the "150 g sheet" type (step S516), it is determined that the image forming apparatus 100 is in an operational condition F. It should be noted that the operational conditions in FIG. 5B are shown by way of example, and therefore, and in actuality, classification of operational conditions is performed by combining a plurality of conditions. Further, for simplicity of explanation, the case where none of the above-mentioned operational conditions D to F hold is omitted from description.

As described above, the image forming apparatus 100 at the user site and the data server 200 on the dealer side are interconnected, at all times or as required, by the remote communication network 400 so as to enable communication to be performed between the two, using a predetermined protocol.

The data collected by the image forming apparatus 100 is sent to the data server 200 on the dealer side to be computed by the computer 500 connected to the data server 200 via the LAN 403. The result of the computation is compared with the component data of the consumable components managed by the component managing server 300, by the computer 600 connected to the component managing server 300 via the LAN 405. A person in charge of component management selects a consumable component suited to the operational environment and operational condition of the image forming apparatus 100 at the user site, based on the result of the comparison. Consumable components are classified as shown in FIG. 6 by way of example, whereafter a suitable consumable component is selected.

Figures 6, 7:
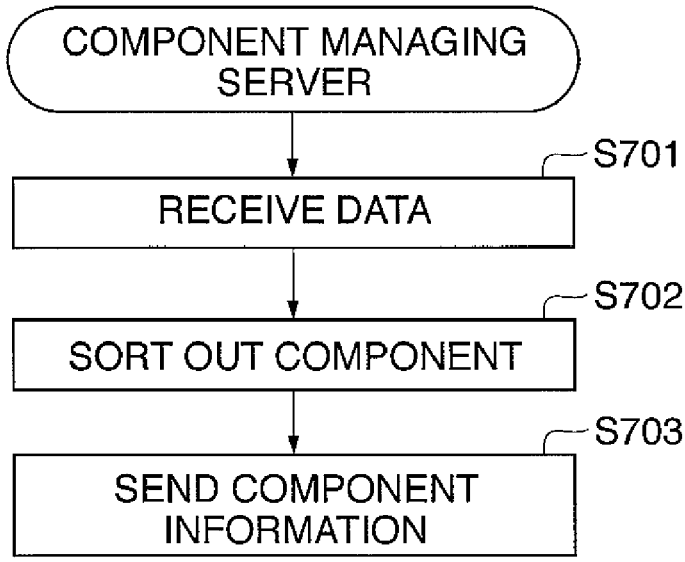
FIG. 6 is a diagram showing examples of combinations of an operational environment and an operational condition, which are classified according to respective ranges of electric resistance of the secondary transfer roller.
FIG. 7 is a flowchart of a component sorting process executed by a component managing server.

FIG. 6 is a diagram showing examples of suitable combinations of an operational environment (A, B, or C) and an operational condition (D, E, or F), which are classified according to respective ranges of the electric resistance of the secondary transfer roller.

Referring to FIG. 6, a combination AD, of the operational environment A and the operational condition D, a combination AE of the operational environment A and the operational condition E, a combination AF of the operational environment A and the operational condition F, and a combination BD of the operational environment B and the operational condition D are suitable for a secondary transfer roller whose electric resistance falls within a range of $9\times10^6$ to $1\times10^7$ (Ω). A combination BE of the operational environment B and the operational condition E is suitable for a secondary transfer roller whose electric resistance falls within a range of $1\times10^7$ to $2\times10^7$ (Ω). Further, a combination BF of the operational environment B and the operational condition F, a combination CD of the operational environment C and the operational condition D, a combination CE of the operational environment C and the operational condition E, and a combination CF of the operational environment C and the operational condition F are suitable for a secondary transfer roller whose electric resistance falls within a range of $2\times10^7$ to $3\times10^7$ (Ω).

FIG. 7 is a flowchart of a component sorting process executed by the component managing server 300. First, the component managing server 300 receives operational environment data and operational condition data sent from the data server 200 (step S701). Then, the component managing server 300 selects a suitable component (secondary transfer roller in the case of the illustrated example) by referring to the table shown in FIG. 6 according to a combination of the operational environment and the operational condition obtained from the data server 200 (step S702).

Then, the component managing server 300 sends component information indicative of the selected component to the data server 200 on the dealer side and the image forming apparatus 100 at the user site through the remote communication network 400 (step S703). The component information is shared between the data server 200 and the image forming apparatus 100, so that the component information can be taken out at any location on each of the dealer side and the user site.

The consumable component selected by the component managing server 300 is shipped from the manufacturer and delivered to the user directly or via the dealer. In this case, if the SCM system is employed over the remote communication network 400, it is possible to manage component information and shipment information obtained from the consumable component sorting system according to the present embodiment, in real time.

As described above, according to the present embodiment, the image forming apparatus 100 collects data concerning the operational environment and condition thereof. The data server 200 carries out statistical computation processing based on the data collected by the image forming apparatus 100, and estimates the changes in characteristics of each consumable component. The component managing server 300 calculates conditions of a consumable component having a most suited component characteristic tendency, based on a result of the estimation, and compares the result of the calculation with component data of consumable components to thereby select a consumable component suited to the operational environment and operational condition of the image forming apparatus.

In short, consumable components for use in an image forming apparatus and data collected in the image forming apparatus are associated with each other, and the consumable components which vary in characteristics are sorted according to the operational environment and condition, whereby the supply destination of each of the consumable components different in manufacturing process is optimized. This makes it possible to prolong the service lives of the respective consumable components as well as to reduce cost burdened on the user. Further, a manufacturer need not manufacture more consumable components than necessary, which makes it possible to reduce load on environment caused by manufacturing load and waste disposal load.

Although in the above described embodiment, the secondary transfer roller is described as an example of a consumable component for use in an image forming apparatus, this is not limitative, but the present invention can be applied to other various consumable components (the fixing roller, the photosensitive drum, etc.) whose service lives change according to the operational environment and operational condition of an associated image forming apparatus.

Although in the above described embodiment, various values of the electric resistance, surface roughness, and hardness of the secondary roller, temperature and humidity based on which operational environments are classified, and sheet basis weight based on which operational conditions are classified are mentioned by way of example, but this is not limitative, but the values can be changed to desired values, as deemed appropriate, without departing from the sprit and scope of the present invention.

It is to be understood that the object of the present invention may also be accomplished by supplying a system or an apparatus with a storage medium in which a program code of software, which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2006-230731 filed Aug. 28, 2006, which is hereby incorporated by reference herein in its entirety.

What is claimed is:

1. A consumable component sorting system including (a) an image forming apparatus having a consumable component exchangeably mounted therein, (b) an information managing apparatus, and (c) a component managing apparatus, which are communicably connected to each other, wherein the image forming apparatus comprises an information collecting unit configured to collect information at least on an operational environment of the image forming apparatus, wherein the information managing apparatus comprises an estimating unit configured to estimate a change in characteristics of the consumable component based at least on the information on the operational environment of the image forming apparatus collected by said information collecting unit, wherein the component managing apparatus comprises a sorting unit configured to select a new consumable component from a plurality of consumable components of a same type for the image forming apparatus, each of the plurality of consumable components exhibiting different characteristics suitable for different operational environments, and the sorting unit configured to select the new consumable component at least by determining that the new consumable component has characteristics better suited to the operational environment of the image forming apparatus as compared to the other consumable components of the same type for the image forming apparatus, based on a result of the estimation of said estimating unit, and wherein the information on the operational environment of the image forming apparatus includes information on temperature, humidity, or both temperature and humidity.

2. A method of controlling a consumable component sorting system including an image forming apparatus having a consumable component exchangeably mounted therein, an information managing apparatus, and a component managing apparatus, which are communicably connected to each other, comprising:

an information collecting step of collecting information at least on an operational environment of the image forming apparatus;

an estimating step of estimating a change in characteristics of the consumable component based at least on the information on the operational environment of the image forming apparatus collected in said information collecting step; and a sorting step of selecting a new consumable component from a plurality of consumable components of a same type for the image forming apparatus, each of the plurality of consumable components exhibiting different characteristics suitable for different operational environments, and the sorting unit configured to select the new consumable component at least by determining that the new consumable component has characteristics better suited to the operational environment of the image forming apparatus as compared to the other consumable components of the same type for the image forming apparatus, based on a result of the estimation in said estimating step, wherein the information on the operational environment of the image forming apparatus includes information on temperature, humidity, or both temperature and humidity.

* * * * *